US009169598B2

(12) United States Patent
Straub et al.

(10) Patent No.: US 9,169,598 B2
(45) **Date of Patent: *Oct. 27, 2015**

(54) SPLICED ENDLESS CLOTHING

(75) Inventors: Michael Straub, Steinheim (DE); Matthias Hoehsl, Heidenheim (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/234,045

(22) PCT Filed: Jul. 20, 2012

(86) PCT No.: PCT/EP2012/003352

§ 371 (c)(1),
(2), (4) Date: Jan. 21, 2014

(87) PCT Pub. No.: WO2013/010678

PCT Pub. Date: Jan. 24, 2013

(65) Prior Publication Data

US 2014/0166224 A1 Jun. 19, 2014

(30) Foreign Application Priority Data

Jul. 20, 2011 (DE) ..... 10 2011 079 517

(51) Int. Cl.
*D21F 1/00* (2006.01)
*D21F 7/10* (2006.01)

(52) U.S. Cl.
CPC ..... *D21F 1/0027* (2013.01); *D21F 1/0036* (2013.01); *D21F 1/0054* (2013.01); *D21F 7/10* (2013.01)

(58) Field of Classification Search
USPC ..... 162/348, 358.2, 900, 904; 428/62, 193
See application file for complete search history.

(56) References Cited

U.S. PATENT DOCUMENTS

| | | | | |
|---|---|---|---|---|
| 4,369,081 | A | 1/1983 | Curry et al. | |
| 4,541,895 | A | 9/1985 | Albert | |
| 5,670,230 | A | 9/1997 | Schlueter Jr. et al. | |
| 6,290,818 | B1 * | 9/2001 | Romanski | 162/358.4 |
| 7,413,633 | B2 * | 8/2008 | Li et al. | 162/358.4 |
| 2004/0026058 | A1 | 2/2004 | Watanabe et al. | |
| 2010/0230064 | A1 | 9/2010 | Eagles et al. | |

FOREIGN PATENT DOCUMENTS

EP 1378602 A1 1/2004

* cited by examiner

*Primary Examiner* — Mark Halpern
(74) *Attorney, Agent, or Firm* — Laurence A. Greenberg; Werner H. Stemer; Ralph E. Locher

(57) ABSTRACT

A clothing fabric for a paper machine has two or more endless strips, which are each formed by a film-like web spliced along a joint to form a film-like web that is endless in the direction of circulation of the fabric. The endless strips are connected to one another at the side edges with the joints of two endless strips that are connected to each other are arranged to be offset in relation to one another with respect to the direction of circulation of the fabric.

15 Claims, 5 Drawing Sheets

SPLICED ENDLESS CLOTHING

This application is a 371 of PCT/EP2012/003352 filed 20 Jul. 2012

BACKGROUND OF THE INVENTION

Field of the Invention

The present invention relates to fabrics for paper machines and refers in particular to nonwoven fabrics and the production thereof.

Paper machines are used to produce fibrous nonwoven webs such as papers of an extremely wide range of grades, boards, paperboards and similar nonwoven materials. In this document, the term "paper" will be used as representative of these types of fibrous nonwoven webs.

The production of a fibrous nonwoven web begins in the forming section of a paper machine with the application of a fibrous suspension to a fabric or with the introduction of a fibrous suspension into the gap formed between two fabrics. Fabrics are normally implemented in the form of endless strips which, deflected over rolls, each run around within a specific part or section of the paper machine. The paper-side surface of the fabric bears the fibrous suspension or the fibrous web or fibrous nonwoven web produced there from by dewatering. The surface of the fabric that is led over the rolls will be designated below as the running side, the paper-side surface, provided to transport the fibrous suspension or web will be designated as the useful side. For the purpose of dewatering, the fabrics have passages, via which the water can be sucked away from the paper-side surface toward the running side.

The fabrics currently used as forming fabrics in the forming section of paper machines consist of woven material. Woven fabrics have regular structures with a repeating basic pattern. The forming fabrics are normally built up from a plurality of woven layers of different thread thickness and thread guidance. On account of their different woven structure, the individual layers of such fabrics not only have permeabilities for water that differ from one another but, since the openings or passages formed in the paper-side layers are regularly covered by yarns of woven layers lying underneath, also lead to laterally varying permeabilities of the forming fabric and therefore to a locally varying dewatering rate of the fibrous web. The result is visible markings of the paper web with a regular arrangement following the weaving pattern. Since less dewatered regions of a paper web furthermore also have a lower fiber density, lateral permeability fluctuations can impair the quality of the paper web to be produced.

Woven fabrics also have a low flexural rigidity and therefore frequently tend to form creases as they circulate in paper machines. The use of monofilaments of different materials, such as for example a combination of yarns made of polyethylene terephthalate (PET) and polyamide (PA), on the running side of a fabric, because of the different characteristics of these materials with respect to water uptake, stretch, etc, often leads to forming fabric edges that stand up or stick out.

Since fabrics cannot be woven as an endless strip, the two ends of a finitely long woven strip have to be joined to each other in order to form an endless strip. In order to avoid irregularities at the joint, which can lead to markings of the paper web, the joining is carried out via a complicated woven seam structure, in which the ends of associated ends of warp and weft threads that are assigned to each other are spliced to one another with an offset in accordance with a specific pattern at the joint of the woven strip. This joining technique is very complicated and is reflected in correspondingly high production costs for woven endless fabrics.

As an alternative to woven fabrics, fabrics have been proposed which are produced from nonwoven material webs. In the patent specifications CA 1 230 511 and U.S. Pat. No. 4,541,895, for example, a fabric is specified which is formed from a laminate made of a plurality of layers of nonwoven, water-impermeable materials. Openings are introduced into the laminate for the purposes of dewatering. The individual layers of the laminate are joined flat by means of, for example, ultrasonic welding, high-frequency welding, thermal welding, adhesive bonding or chemical pre-treatment of the layers. The dewatering holes are introduced into the laminate, preferably by means of laser drilling. The spliced seam of a layer can be arranged to be offset from the other layers; the spliced seams can furthermore also be arranged at an angle to the running direction of the endless strip, in order to avoid noticeable thickenings of the fabric. However, producing such film laminates in the dimensions required for forming fabrics entails a great deal of effort. In addition, such multilayer film laminates are relatively stiff and tend to delaminate under the conditions prevailing during use in the forming section of a paper machine.

If polymer strips are used for producing fabrics for paper machines, said strips have to be oriented in the running direction of the fabric, otherwise the fabric will be stretched irreversibly under the tensile stresses prevailing in operation and thus become unusable after a short time. However, appropriately unidirectionally oriented polymer strips are not available in the widths which are usual for fabrics of paper machines used on an industrial scale. In order to produce a fabric, it is therefore necessary for a plurality of polymer strips subsequently to be joined to one another laterally beside one another. In order to obtain a fabric in the form of an endless strip, the ends of the strip additionally have to be joined together. At the connecting points or joints, the material is not oriented, which means that the fabric at these points exhibits a correspondingly lower mechanical stability.

In order to solve this problem, patent application US 2010/0230064 proposes a fabric for use in paper machines which is produced from a spirally wound polymer strip. The width of the polymer strip is substantially smaller than the width of the fabric produced there from, the longitudinal direction of the polymer strip, apart from the oblique position given by the height of the windings, coinciding with the running direction of the fabric. The side edges respectively opposite one another of adjacent windings of the polymer strip are welded to one another in order to form a closed running surface. Since the welded seam is arranged at a relatively small angle with respect to the running direction of the fabric, the components of the tensile stress acting transversely with respect to the welded seam are low, so that, in the ideal case, the non-oriented material of the welded seam is not loaded excessively. The production of a fabric from a spirally laid polymer strip is very complicated, however, since it requires a special welding apparatus in which either the welding apparatus has to be guided repeatedly around the fabric with high precision along the welding line, or the fabric has to be displaced with the circulating welding line relative to the welding apparatus. In addition, after the welding operation, the edges of the fabric have to be trimmed in order to obtain a uniformly wide fabric. As a result, the welded seam abuts one of the side edges of the fabric at an acute angle, which means that, on account of the welded seam that is structurally weaker as compared with the polymer strip, a point of attack for tearing of the fabric is provided.

BRIEF SUMMARY OF THE INVENTION

On the basis of that explained, it is therefore desirable to specify a fabric for paper machines which is formed in the shape of a film, has a high mechanical stability and tensile strength, is sufficiently wide for use in industrially used paper machines and can be fabricated by using conventional means.

Embodiments of such fabrics for a paper machine have two or more endless strips, which are each formed by a film-like web closed along a joint to form a film-like web that is endless in the direction of circulation of the fabric, wherein the endless strips are connected to one another at the side edges such that the joints of two endless strips that are connected to each other are arranged to be offset in relation to one another with respect to the direction of circulation of the fabric.

In this connection, it is pointed out that the terms "comprise", "have", "include", "contain", and "with" used in this text and in the claims in relation to the enumeration of features, and also the grammatical modifications thereof, generally designate a non-final enumeration of features, such as method steps, apparatuses, regions, sizes and the like, and in no way rule out the presence of further and other features or groupings of other or additional features.

The joint in a film-like web has properties that differ from the remaining web material, which manifest themselves in a lower tensile strength and higher extensibility of the joint. As a result of the offset of the joints, a tensile force acting on the fabric in the area of the joint of one of the endless strips is absorbed by the adjacently arranged non-joined film material of an adjacent endless strip and, in this way, overloading and stretching of the joint is effectively prevented.

In advantageous embodiments, the film-like webs are formed from a polymer that is oriented unidirectionally in the direction of circulation of the fabric, which achieves a high dimensional stability of the fabric in proper use. In order to be suitable for use in paper machines, film-like webs in embodiments of the fabric are formed on the basis of a material which is chosen from polyethylene terephthalate (PET), polyethylene naphthalate (PEN), polyphenylene sulfide (PPS), polyether ether ketone (PEEK), polyamide (PA) or polyolefines. For use in paper machines, the thickness of the film-like webs in embodiments is further preferably chosen from the range from 300 to 1600 μm and in particular preferably from the range from 500 to 800 μm.

It is conceivable for the film-like webs to be formed from a non-oriented polymer and, in order to provide the tensile strength of the fabric, for threads extending in the direction of circulation of the fabric, in particular spirally wound threads, to be provided.

The film-like webs in embodiments are preferably at least partially integrally connected at the joints, in order to avoid the joint opening, for example with the effect of gap formation during use of the fabric. An integral connection is understood to mean the connecting partners being held together by atomic or molecular forces. In further embodiments, the endless strips are connected integrally to one another, in order to create a seamless transition between the mutually adjoining endless strips.

In advantageous embodiments, the active surfaces of a joint and/or of a lateral connecting point are arranged in the form of a staircase, so that part of the connecting surface is not penetrated perpendicularly by the tensile forces that occur, and in this way the dimensional stability of the connecting point is increased. In this case, the active surfaces designate the surfaces adjoining one another at the connecting point. In order to enlarge the connecting surface and in order to increase their ability to be irradiated, at least one active surface of a joint and/or of a lateral connecting point is arranged as a surface inclined with respect to the surfaces of the fabric.

According to a further embodiment of the invention, at least one joint extends along a line, in particular a straight line, extending diagonally in relation to the direction of circulation. In this way, the length of the joint can be made greater than the width of the film-like web, which means that the tensile force acting on the joint is distributed to a longer joint. In this way, the durability of the joint can be improved. A further advantage in the diagonal course of the joint is that, as the fabric passes through a nip, the entire joint does not pass through the nip at the same time, instead only a small section in each case. In this way, any markings possibly caused by the joint are reduced, and the run of the fabric in the machine also becomes more stable.

It is also conceivable for the fabric to comprise a plurality of film-like webs arranged one above another and connected flat to one another. In this connection, it is in particular conceivable for the joints of film-like webs arranged one above another to extend diagonally with respect to the direction of circulation and to enclose different angles with the direction of circulation.

Further features of the invention can be gathered from the following description of exemplary embodiments in conjunction with the claims and the appended figures. It should be pointed out that the invention is not restricted to the versions of the exemplary embodiments described but is determined by the scope of the appended patent claims. In particular, in embodiments according to the invention, the features listed in the exemplary embodiments explained below can be implemented in numbers and combinations differing from the examples. In the following explanation of some exemplary embodiments of the invention, reference is made to the appended figures, in which:

In the figures, the same or similar designations are used for functionally equivalent or similar characteristics, irrespective of specific embodiments.

DESCRIPTION OF THE INVENTION

Figure 1:
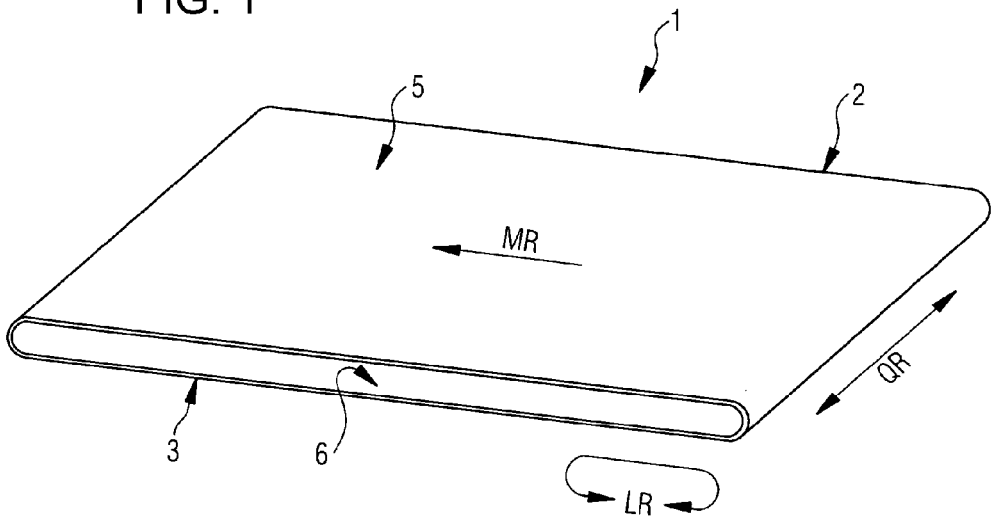
FIG. 1 shows a fabric implemented as an endless strip in a schematic perspective illustration.

FIG. 1 shows a schematic illustration of a fabric 1 for use in machines for paper production. The width of the fabric 1 is delimited by the side edges 2 and 3. The two side edges are intrinsically closed and arranged substantially parallel to each other. The fabric 1 is therefore also designated an endless fabric. The direction in which the endless fabric 1 is intrinsically closed is designated below as the running direction LR or direction of circulation LR of the fabric 1 and is illustrated in FIG. 1 by means of a curved double arrow. The direction along the shortest connection between the two side edges 2 and 3 is designated the transverse direction QR and is indicated graphically in FIG. 1, likewise with the aid of a double arrow. The fabric 1 has a useful surface 5, which is used to transport the fibrous suspension or web during paper production, and is also designated the paper-side surface 5 of the fabric 1. The useful surface 5 of the fabric 1 generally forms the surface of the fabric 1 that is oriented outward. In this text, the inwardly directed surface, facing the volume enclosed by the fabric 1, is designated the running side 6. It normally rests on the rolls (not shown in the figures) which effect the circulation of the fabric 1. The directions pointing from the running side to the paper-side surface of the fabric 1 will be designated the vertical direction of the fabric 1 below. The conveyance of fibrous suspension or fibrous web on the fabric 1 is carried out on the useful surface 5 of the latter in the machine direction MR, indicated by an arrow.

Figure 2:
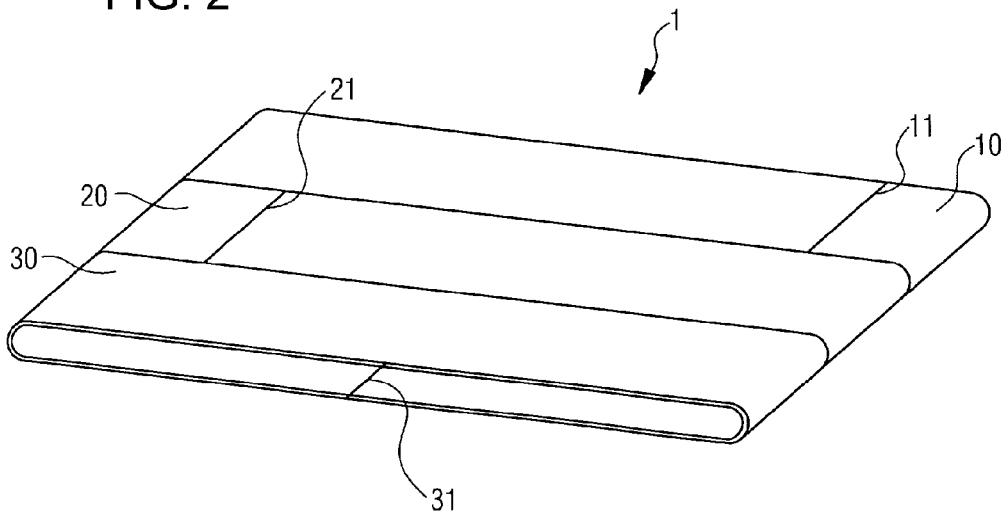
FIG. 2 shows the structure of a fabric implemented as an endless strip made of a plurality of film-like webs joined to form endless strips, illustrated schematically in a perspective illustration.

FIG. 2 illustrates the structure of an endless fabric 1, as shown in FIG. 1, made of a plurality of film-like webs. In the exemplary embodiment shown in FIG. 2, the fabric 1 is built up from three film-like webs 10, 20 and 30 arranged beside one another in the transverse direction QR. The number of film-like webs used or needed to build up a fabric 1 is determined from the width of the fabric 1, i.e. the extent of the latter in the transverse direction QR, and the width of the film-like webs available for the production thereof. Accordingly, the number of film webs arranged beside one another to produce a fabric 1 can be only two but also more than three, departing from the embodiment shown in FIG. 2. Furthermore, it is not necessary for all the film webs to be equally wide. Instead, in order to form a fabric 1, film webs of different widths can be joined to one another, for example such that the outer film webs 10 and 30 are shortened in the transverse direction QR in order to obtain a specific predefined width of the fabric 1. If the tensile loading acting on the fabric 1 in the envisaged application of the latter varies along the transverse direction QR thereof, the width of the individual film-like webs 10, 20 and 30 can be optimized to the local tensile loading, for example by a smaller width of the film-like web being chosen in the case of a higher tensile loading.

The individual film-like webs 10, 20 and 30 are constructed monolithically, which in this text is to be understood to mean that the webs, apart from any possible surface coating, consist of one piece, i.e. are in particular not built up in several plies. The film webs 10, 20 and 30 can be perforated, depending on the intended purpose, i.e. they can have vertically penetrating holes, for example for dewatering the fibrous web.

Figure 3A:
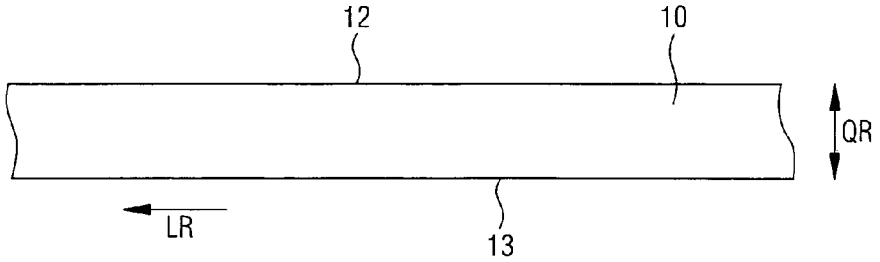
FIG. 3 shows film-like webs having differently embodied side edges, illustrated schematically.
Figure 3B:
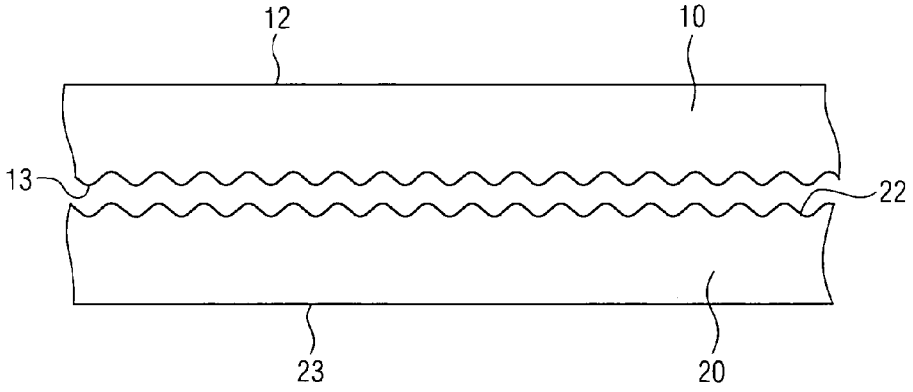

Each of the film webs used to produce a fabric 1 has two side edges delimiting its extent in the transverse direction QR, as shown in the illustrations a) and b) of FIG. 3. In the case of the film-like web 10 shown in illustration a) of FIG. 3, these are the side edges 12 and 13; in the case of the film-like webs 10 and 20 shown in illustration b) of FIG. 3, these are the side edges 12 and 13 and, respectively, 22 and 23. Usually, the side edges of the film-like webs 10, 20 and 30 are formed rectilinearly, as illustrated in FIGS. 2 and 3*a*). For the purpose of a toothed connection of two adjoining webs, as illustrated in FIG. 3*b*), the side edges 13 and 22 to be connected can also run along a two-dimensional line, for example along a serpentine line or a wavy line.

Figure 4:
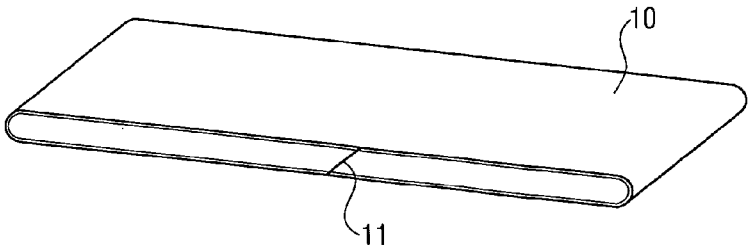
FIG. 4 shows a film-like web joined to form an endless strip in a schematic perspective illustration.

To form an endless fabric 1, preferably each of the individual film-like webs 10, 20 and 30 are firstly joined along a joint 11, 21 and 31, respectively, to form an endless strip. The schematic illustration of FIG. 4 shows a film-like web 10 joined at a joint 11 to form an endless strip. The joint 11 connects the two end edges of the film-like web 10. In this case, end edges are to be understood as the edges bounding the film-like web 10 between the side edges 12 and 13 thereof, which delimit the longitudinal extent thereof and thus form the ends of the web. The end edges can be arranged at right angles to the course of the side edges, as illustrated in the figures. However, they can also be aligned obliquely with respect thereto and, instead of a rectilinear course, can also have a curved course.

The ends of a film web 10 can be joined by using different joining techniques, such as for example adhesive bonding, calendaring and in particular welding. In order to weld the two web ends, an ultrasonic welding method or a transmission laser welding method can be used. In the transmission laser welding method, the touching surfaces of the two web ends are melted by means of an NIR laser (laser with an emission wavelength in the near infrared range) and pressed onto one another. Since the material of the film strips 10, 20, 30 does not absorb the light from an NIR laser, the surfaces to be melted must previously be provided with an absorber coating; it is generally sufficient to coat only one of two surfaces touching at the joint with a material absorbing the NIR laser light. The absorber coating absorbs the light from the NIR laser used for the welding, heats up as a result and consequently melts the surface regions of the web ends adjacent thereto. By means of pressing the molten regions onto one another, an integral connection is ultimately produced.

Suitable lasers for NIR transmission welding are, for example, diode lasers with emission wavelengths in the range from 808 to 980 nm and Nd:YAG lasers with an emission wavelength of 1064 nm. Preferably, lasers with emissions in the range from 940 to 1064 nm are used.

Figure 5A:
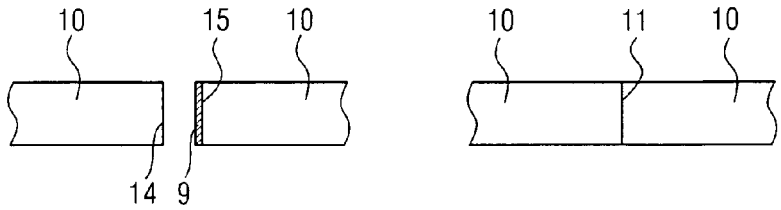
FIG. 5 illustrates two examples of an edge formation for producing an end to end joint.
Figure 5B:
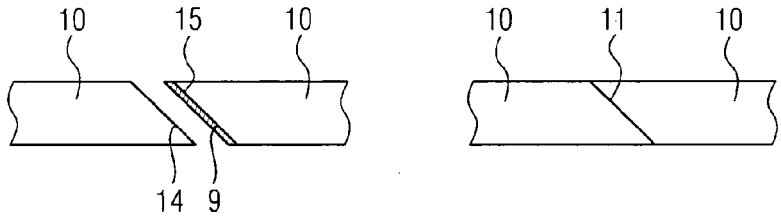

The two end edges of a film-like web 10 can be joined end-to-end or by using profiling of the ends forming the same. Here, end-to-end is to be understood to mean the ends of a film web 10 running at right angles or obliquely with respect to the useful or running side meeting each other. FIG. 5 illustrates two examples of end-to-end joining of two butt edges 14 and 15 of a film-like web 10, the cross-sectional illustrations illustrating the mutually oppositely arranged ends 14 and 15 respectively in the non-joined (left) and joined (right) state. Before the joining, one of the two ends can be provided, as shown, with an absorber coating 9, which absorbs the welding light used and in this way effects the melting of the two ends. Alternatively, both ends 14 and 15 can also be coated with an absorber material. In the case of the joint 11 illustrated in the illustrations a), the ends 14 and 15 are arranged at right angles to the two surfaces of the film-like web 10. In this case, the welding light is preferably radiated in at an angle to the mutually adjoining end faces 14 and 15 and therefore also at an angle to the two surfaces of the film-like web 10. In the case of welding light radiated in at right angles to one of the two surfaces of the film web 10, the two end faces are preferably arranged obliquely with respect to the surface and therefore also obliquely with respect to the irradiation direction of the light, as illustrated in illustration b) of FIG. 5. Given such an oblique arrangement of the end faces, the joint 11 has a greater area, which means that the tensile loading per unit area thereof when the film-like web 10 is tensioned, is reduced.

Figure 6:
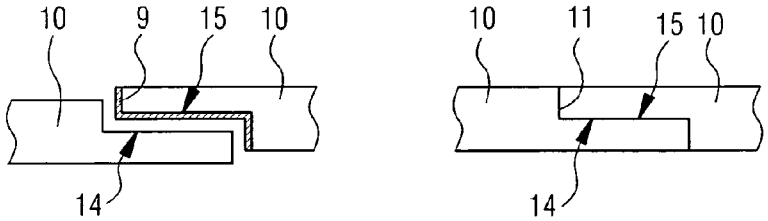
FIG. 6 presents a staircase-like edge formation for producing a profiled joint.

Via profiling the ends 14 and 15, the area of the joint 11 can be enlarged further and the stretching thereof under tensile loading can be reduced further. In the example illustrated in FIG. 6, the two web ends or butt surfaces 14 and 15 of a film web 10 have mutually complementary stepped profiling. Here, too, once more an absorber layer 9 can be used to absorb the welding light. In order to achieve a high strength, the step length is preferably a multiple of the film thickness here. Step lengths from the range from 5 to 150 mm are advantageous, step lengths around about 20 mm being preferred. Multiple steps are likewise possible. As distinct from the embodiment illustrated in FIG. 6, the steps of the profile can also be formed at an angle, by which means good illumination of the end faces 14 is achieved when welding light is aimed perpendicularly at the surface of the film-like web 10. The angle between the oblique ramps and the plateau of such a step lying between preferably has a value from the range from 45 to 60 degrees, an angle of 60 degrees being preferred.

Figure 7:
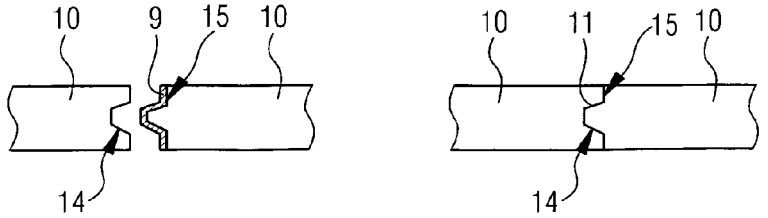
FIG. 7 shows tongue-and-groove profiling of joint edges.

A further example of butt edge profiling is shown by FIG. 7. In this embodiment, the butt surfaces 14 and 15 to be joined of the film web 10 are pre-processed in the form of a complementarily configured tongue-and-groove profile, tongue and groove preferably being implemented with a slight taper, as shown, in order to permit them to slide easily into one another. This profile form is distinguished in particular by high security with respect to undesired vertical offset of the two web ends as they are connected. The tongue length and groove depth can exceed the film thickness. As previously, given this profile configuration, an absorption layer 9 can also be applied to one or to both butt surfaces 14 and 15, in order to facilitate the joining of the surface substrate ends by means of locally concentrated absorption of the welding light. If the butt surfaces 14 and 15 of the film web ends are connected to each other by means of ultrasonic welding, no absorbent coating 9 is needed.

When joining the film web ends with the aid of an NIR transmission welding method, the individual film strips are preferably made of a polymer which is transparent to the light wavelengths used for the welding. The film-like webs used are therefore advantageously flat substrates produced by extrusion or casting, for example, made of thermoplastics such as for example polyethylene terephthalate (PET), polyethylene naphthalate (PEN), polyphenylene sulfide (PPS), polyether ether ketone (PEEK), polyamide (PA), polyolefines and polyimides (PI). These materials are known in the form of uniaxially oriented plates or roll products and are obtainable on the market. For the production of fabrics 1 for paper machines, film web thicknesses from the range from 150 up to 1600 μm and in particular from the range from 500 to 800 μm are preferably used.

When welding the ends of uniaxially oriented film webs 10, the material structure within the joining zone 11 is destroyed, for example by re-crystallization, which means that the joining zone can be loaded less mechanically and chemically and, as a result, it is possible for undesired corrugations and distortions at the joining zone 11 to occur during proper use. During the production of endless fabrics 1, the joining zones 11, 21 and 31 of the individual endless strips 10, 20 and 30 etc are therefore arranged offset relative to one another with respect to the direction of circulation LR of the fabric, as illustrated in FIG. 2. This offset arrangement relieves the load on the individual joints, in that tensile forces acting on the fabric 1 at the level of the joints are absorbed by the non-disrupted film material of the respectively adjoining adjacent webs. In this way, stretching of the joints is effectively prevented, so that the endless fabric does not form any corrugations or distortions during proper operation.

The tensile forces acting on the fabric 1 at right angles to the direction of circulation LR are substantially lower than those acting longitudinally with respect thereto, so that during normal operation no stretching of the connecting points between the individual endless strips 10, 20 and 30 occurs. The connection of mutually adjacent endless strips can be carried out, like the joining of the end edges of the film-like webs, by means of ultrasonic welding or transmission laser welding. Two side edges 13, 14 can be connected end-to-end in a manner analogous to the end edges of a film web or by using profiling of the edge surfaces forming the side edges.

Figure 8:
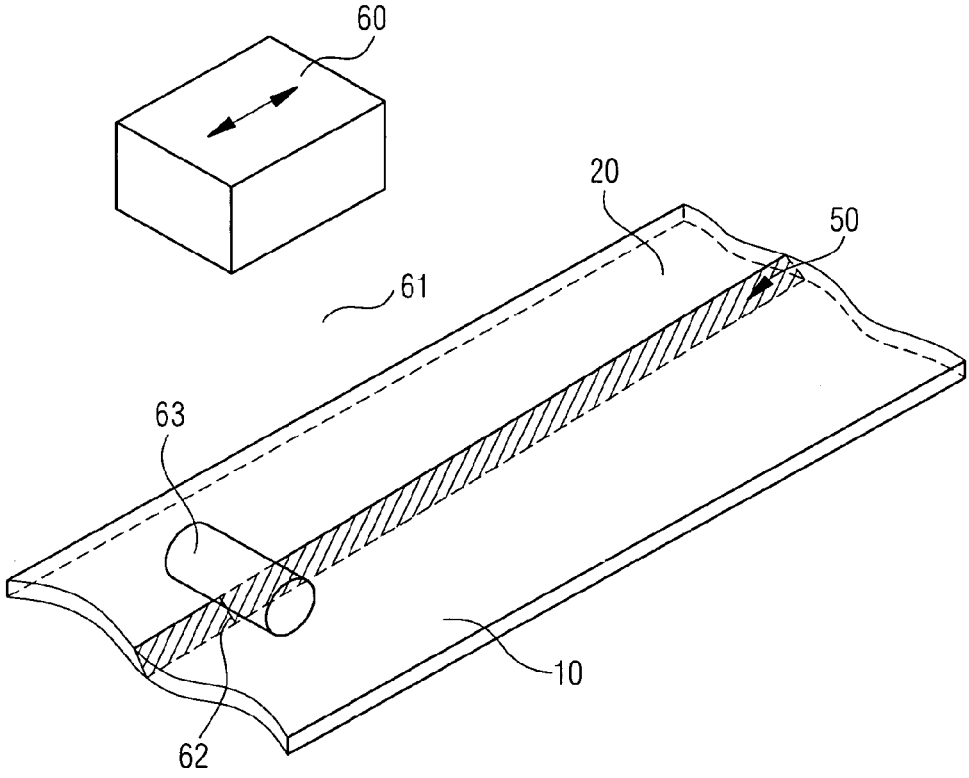
FIG. 8 shows a first arrangement for the transmission laser welding of two mutually adjoining edges in a schematic perspective illustration.

The schematic illustration of FIG. 8 shows an arrangement for the flat transmission laser welding of the two endless strips 10 and 20 at their side edges. The adjacent edge surfaces are beveled, so that the NIR laser light 61 radiated in at right angles to the surfaces of the endless strips 10 and 20 strikes the edge surfaces laterally. At least one of the two edge surfaces is provided with an absorber coating. In the welding arrangement illustrated, the fan-like light beam 61 emitted by a laser 60 is converged linearly onto the connecting area 50 via a roll 63 that is transparent to the wavelength used, through the film material of the endless strips 10 and 20, which is transparent to the laser light. The laser energy concentrated in this way is absorbed in the region of the line 62 on the connecting surface 50 and converted into thermal energy. The transparent roll 63 presses with a predefined force onto the surfaces of the endless film webs 10 and 20, so that the two webs are pressed against each other in the region around the linear melting zone 62. By moving the irradiation arrangement comprising the laser 60 and the transparent pressure roll relative to the connecting surface 50 or, conversely, by appropriately displacing the two endless strips 10 and 20 relative to the irradiation arrangement, the two endless strips 10 and 20 are connected to each other integrally over the entire area in the region of the connecting surface 50.

Figure 9:
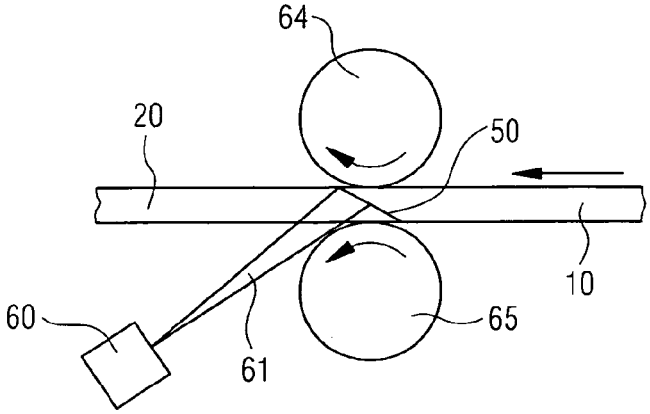
FIG. 9 shows a second arrangement for the transmission laser welding of two mutually adjoining edges in a schematic cross-sectional illustration.

In an alternative transmission laser welding method, as illustrated schematically in FIG. 9, the connecting surface 50 is led through in the nip formed between two rolls 64 and 65 such that the edge surfaces of the film-like webs 10 and 20 abutting one another at the connecting surface 50 are pressed against one another. In the arrangement illustrated, the connecting surface 50 passes the nip in the transverse direction QR for reasons of clearer illustration. Usually, however, the rolls 64 and 65, like the transparent roll of FIG. 8, are arranged such that the connecting surface 50 is led through the nip between the rolls 64 and 65 in the running direction LR. Preferably, the laser source 60 irradiates the part of the connecting surface 50 located in the nip over the entire extent of said connecting surface in the transverse direction QR.

A fabric 1 made from a plurality of film-like webs joined in accordance with the above explanations can be made in any desired width and therefore matched to the requirement of a respective paper machine by using conventional joining techniques. A fabric 1 made as explained previously exhibits high mechanical stability and tensile strength and, in proper operation, does not tend to form corrugations or distortions.

Figure 10:
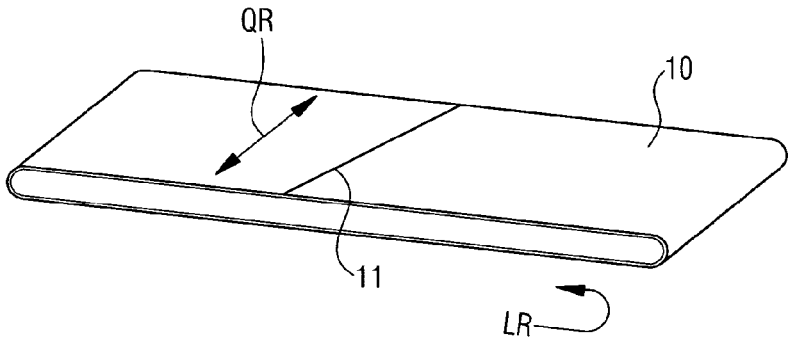
FIG. 10 shows a film-like web having a joint extending diagonally with respect to the direction of circulation.

FIG. 10 shows a film-like web 10 having a joint 11 running diagonally with respect to the direction of circulation LR.

The invention claimed is:

1. A clothing fabric for a papermaking machine, comprising:

two or more endless strips each formed of a film-like web that is closed along a joint to form a closed web that is endless in a direction of circulation of the fabric in the papermaking machine;

said joint connecting respective end edges of a respective film-like web with respective end edges joined end-to-end in an abutting relationship, said end edges forming edges bounding the film-like web between respective lateral edges, delimiting a longitudinal extent thereof and forming the ends of the web;

individual said film-like webs being constructed monolithically in form of extruded or cast substrates of thermoplastic plastics material having a thickness ranging from 150 to 1600 μm;

said film-like webs being at least partially integrally connected at said joints, in order to avoid joint opening and a gap formation during use of the clothing fabric; and said endless strips being connected to one another at lateral edges thereof, with said joints of two mutually adjoining endless strips that are connected to each other being arranged with an offset relative to one another with respect to the direction of circulation of the fabric.

2. The clothing fabric according to claim 1, wherein said film-like webs are formed of a polymer that is oriented unidirectionally in the direction of circulation of the fabric.

3. The clothing fabric according to claim 1, wherein said film-like webs are formed of a non-oriented polymer and including threads extending in the direction of circulation of the fabric for imparting tensile strength to the fabric.

4. The clothing fabric according to claim 3, wherein said threads are spirally wound threads.

5. The clothing fabric according to claim 1, wherein said film-like webs are formed of a base material selected from the group consisting of polyethylene terephthalate, polyethylene naphthalate, polyphenylene sulfide, polyether ether ketone, polyamide, and polyolefines.

6. The clothing fabric according to claim 1, wherein said film-like webs have a thickness in a range from 300 to 1600 μm.

7. The clothing fabric according to claim 1, wherein the thickness of said film-like webs lies in a range from 500 to 800 μm.

8. The clothing fabric according to claim 1, wherein said film-like webs are integrally connected at said joints.

9. The clothing fabric according to claim 1, wherein active surfaces of a joint and/or of a lateral connecting point are disposed in a staircase form.

10. The clothing fabric according to claim 1, wherein an active surface of a joint and/or of a lateral connecting point is arranged as a surface that is inclined with respect to a main surface of the fabric.

11. The clothing fabric according to claim 1, wherein at least one joint extends along a line extending diagonally in relation to the direction of circulation of the fabric.

12. The clothing fabric according to claim 11, wherein said line is a straight line.

13. The clothing fabric according to claim 1, wherein the closed web forming the fabric is one of a plurality of film-like closed webs stacked one above another and connected areally to one another.

14. The clothing fabric according to claim 13, wherein respective said joints of said film-like webs that are arranged one above another extend diagonally with respect to the direction of circulation of the fabric and enclose mutually different angles with the direction of circulation.

15. A clothing fabric for a papermaking machine, comprising:

two or more endless strips each formed of a film-like web that is closed along a joint to form a closed web that is endless in a direction of circulation of the fabric in the papermaking machine;

said joint being a welded joint formed by welding respective end edges of the film-like web to one another to connect said film-like webs at least partially integrally in order to avoid joint opening and a gap formation during use of the clothing fabric;

said joint connecting the respective end edges of a respective film-like web, said end edges forming edges bounding the film-like web between respective lateral edges, delimiting a longitudinal extent thereof and forming the ends of the web;

individual said film-like webs being constructed monolithically in form of extruded or cast substrates of thermoplastic plastics material having a thickness ranging from 150 to 1600 μm; and said endless strips being connected to one another at lateral edges thereof, with said joints of two mutually adjoining endless strips that are connected to each other being arranged with an offset relative to one another with respect to the direction of circulation of the fabric.

* * * * *